United States Patent [19]

Pittman et al.

[11] Patent Number: 4,487,260

[45] Date of Patent: Dec. 11, 1984

[54] IN SITU PRODUCTION OF HYDROCARBONS INCLUDING SHALE OIL

[75] Inventors: Robert W. Pittman, Sugarland; Marc F. Fontaine, Houston, both of Tex.

[73] Assignee: Texaco Inc., White Plains, N.Y.

[21] Appl. No.: 584,980

[22] Filed: Mar. 1, 1984

[51] Int. Cl.[3] ..... E21B 43/247

[52] U.S. Cl. ..... 166/259; 166/245

[58] Field of Search ..... 166/259, 52, 245, 263, 166/272, 271

[56] References Cited

U.S. PATENT DOCUMENTS

| | | | |
|---|---|---|---|
| 1,422,204 | 7/1922 | Hoover et al. | 166/272 |
| 2,906,337 | 9/1959 | Hennig | 166/272 |
| 3,233,668 | 2/1966 | Hamilton et al. | 166/259 |
| 3,241,611 | 3/1966 | Dougan | 166/245 |
| 3,349,845 | 10/1967 | Holbert et al. | 166/271 |
| 3,513,913 | 5/1970 | Bruist | 166/259 |
| 4,185,693 | 1/1980 | Crumb et al. | 166/263 |
| 4,446,918 | 5/1984 | Wolcott, Jr. | 166/245 |

*Primary Examiner*—Stephen J. Novosad
*Assistant Examiner*—Bruce M. Kisliuk
*Attorney, Agent, or Firm*—Robert A. Kulason; James J. O'Loughlin; Fontaine C. Armistead

[57] ABSTRACT

A procedure is described for producing hydrocarbons from hydrocarbon-bearing formations including shale oil from an oil shale body wherein combinations of vertical and slant holes are drilled into the shale body, and an alternating sequence of fracturing and production by in situ combustion is performed between those holes.

15 Claims, 8 Drawing Figures

IN SITU PRODUCTION OF HYDROCARBONS INCLUDING SHALE OIL

FIELD OF THE INVENTION

This invention relates to a new procedure for producing hydrocarbons from hydrocarbon-bearing formations including shale oil from oil shale.

Oil shale is a rock formation containing the organic material kerogen. When kerogen is pyrolyzed, the products are hydrocarbon gases and shale oil vapors and liquids. If kerogen is pyrolyzed in place and the gaseous and liquid products are brought to the surface for retorting there without having to mine the oil shale, the procedure is known as an in situ procedure. There are also procedures known as modified in situ procedures, in which the oil shale is explosively rubblized and then retorted in situ. The present invention, however, is a true in situ procedure, in that the retorting is done in place without rubblizing.

BACKGROUND OF THE INVENTION

Oil shale formations contain vast quantities of valuable hydrocarbons. If 50% of the shale oil from the richest deposits in the Green River formation of Colorado, Utah, and Wyoming are recoverable, approximately 600 billion barrels of shale oil could be obtained. This is comparable to proved worldwide reserves of crude oil of about 650 billion barrels. Total shale oil resources of the world, both known resources and possible extensions, are estimated at 24,000 billion barrels. However an economical and environmentally acceptable method of producing these hydrocarbons is still being sought.

Mining of oil shale in order to retort the material at the earth surface is too costly, and furthermore it requires prohibitively large quantities of water, already scarce in the western United States, and in addition it leaves waste heaps of spent shale which are environmentally unacceptable. In fact the waste from retorting oil shale is 50% larger in volume than the extracted oil shale itself.

Efforts to produce shale oil in situ by various methods of heating the oil shale formation have been generally unsuccessful, primarily for two reasons. One reason is that oil shale is a very poor conductor of heat, with the result that it is practically impossible to raise the shale body to retorting temperature (at least 650° F. and preferably 900° F. to 1,000° F.) by conventional means, where a source of heat is applied at one or more points and heat is conducted into the shale body therefrom. The other reason is that oil shale generally has little or no permeability, with the result that even such fluids as may be produced within the oil shale by pyrolysis are unable to find their way out of the shale body to a production well.

Methods have been proposed for opening up passages within the shale body in order to permit the transport of heat in the form of heated fluids into the oil shale and also to permit the removal from the shale of fluid products of pyrolysis. One such method, a modified in situ procedure, involves rubblizing the shale, by explosives for example, to produce many large flow paths for both heat and fluid transport. However, experience with rubblizing has been unsatisfactory because of severe channeling of gas flows through the rubblized bed, which means that the fluids used for driving product out of the shale bed move very unevenly through the bed, with some driving fluid breaking through to the production well while much of the driving fluid is still far back in the bed. Further, it has been found that because of great variablility in size of the chunks of shale after rubblizing there is correspondingly a great variability in their rate of heating up, with the result that the retorting process does not proceed, as is desirable, evenly along a front that moves through the shale bed. Such uneven advance of the front, with large chunks being pyrolyzed later than the small chunks, results in loss of overall efficiency of the process.

Another method, which is known as a true in situ procedure, involves creating fractures, such as by hydrofracturing, in the shale bed and using these fractures as the flow paths for the transport of both the pyrolyzing heat and the fluids resulting from pyrolysis. One such procedure involves the use of hot gases to supply the heat for pyrolysis. Hot gases may be provided in situ in the form of flue gas produced by burning some of the kerogen in the shale body. Burning of the kerogen is initiated by supplying air and a fuel, e.g. propane, to a fracture in the oil shale and igniting the fuel, which in turn initiates combustion in the kerogen. Continuation of the supply of air supports the continued combustion of the kerogen bordering the fracture. As this combustion proceeds through the oil shale from one end of the fracture to the other it is preceded by hot flue gas. The hot flue gas causes pyrolysis of the oil shale, and the combustion which follows the pyrolysis front is supported by the burning of the kerogen residue left after pyrolysis. This method works in principle but has met with little success because of the difficulty of creating a sufficient number of fractures with sufficient capacity for fluid flow.

Accordingly it is an object of the present invention to provide a new process in which, by a novel procedure of alternate fracture and production steps, a sufficient number of fractures with sufficient capacity for fluid flow are created in the oil shale bed to make it possible to achieve efficient, true in situ production of shale oil from oil shale.

Although the following description is expressed as a method for producing shale oil from oil shale, it is to be understood that the method is equally applicable to hydrocarbon-bearing formations other than oil shale, e.g. formations containing petroleum, heavy oils, tar sands, etc.

SUMMARY OF THE INVENTION

This invention involves combinations of vertical and slant hole drilling, efficiently induced fracture, and staged production combined in such a way as to afford an overall technique that will provide an economical approach to shale oil production.

The economical production of shale oil reservoirs with minimum ecological disturbance requires that the kerogen zones be exposed or subdivided and processed in place as opposed to bringing them to the surface by a mining operation which is both costly and undesirable.

In the present invention holes are bored into the shale body in diverging directions such that the holes pass close to each other at certain depths and diverge to greater spacings at other depths. Drilling is preferably done with a rotary percussion (air operated) drill with tungsten carbide bits rather than by conventional rotary means, which have a limited capability of obtaining weight on bit and controlling hole deviation. Conventional hydraulic fracturing is utilized to create permeability between holes where they are close spaced, and in situ combustion is then initiated in these fractures. The combustion process causes thermal fracturing of adjacent zones, and subsequently combustion processes are begun in these thermally fractured zones. Thus a sequence of fracturing and production by in situ combustion and fracturing again, etc. is used advantageously in the present invention to produce shale oil from oil shale formations which heretofore have not lent themselves to efficient production by any previously known fracturing and combustion technique.

An example of the present invention includes a body of oil shale located in the earth beneath a layer of overburden. Holes according to this invention are drilled from the surface of the earth down through the overburden into the oil shale at such spacing on the surface, at such angles, and in such directions that the boreholes intersect or pass very near each other at the depth corresponding to the top of the oil shale body, and these holes diverge as they go deeper into the oil shale body. It is not essential that the boreholes intersect but only that they pass near enough to each other that fracture propagation between them is feasible. Well known hydrofracturing techniques are used at depths where the holes are close to each other to create fractures between the holes.

Once these fractures have been created, well known methods of initiating a combustion process are used to start in situ combustion within these fractures. As this combustion process proceeds, the heat therefrom causes thermal fracturing of adjacent zones deeper in the oil shale body where the distances between the holes are larger than those above. The air or other oxidizing gas utilized to support the in situ combustion at the shorter fractures begins now to flow through the longer fractures which were created by thermal fracturing, and thus the process of in situ combustion grows downwardly through the oil shale body to where the boreholes are farther apart.

Permeable regions created within the shale body by fracturing and also those left by the producing process of this invention may advantageously be prevented from closing by injecting sand or other propping agents in the conventional manner.

The above described group of diverging holes can be thought of as delineating a cone within the shale body. It is not strictly and geometrically a cone but rather a solid geometrical form which is small at the top and large at the bottom and in which the basic horizontal plane figure is not a simple circle as in a cone but something that would be nearer to some polygon, e.g. a square, than to a circle. However for present purposes this figure will be called herein a cone.

The present invention further includes the use of a plurality of such cones with centers located on a grid such as a checker board array with cones centered at each corner of each square in the checker board pattern so that there would be repeated four-spot patterns of such cones. All of the above described cones are normal cones, that is with bases down and vertices up. It will readily be seen that interstitially within this array of normal cones the same boreholes have delineated another array of inverted cones with bases up and vertices down. These inverted cones in the hole array play an important part in a preferred embodiment of the present invention. The operation of the in situ combustion process in the tops of normal cones causes heating and consequent thermal fracturing of the adjacent regions of the adjacent inverted cones, with the result that thermal fracturing occurs in the bases of the inverted cones, where the distance between boreholes is large. Thus this enables the expansion of the in situ combustion process even into the long spaced fractures of the inverted cones. This successive operation of fractures and combustion is used as will be further explained below, to cause the complete in situ combustion and production of the oil shale from the whole shale body.

In addition to the diverging holes discussed above it is advantageous to drill vertical boreholes in the middle of all the normal cones as well as the inverted cones. This results in shorter paths for fracturing and production.

It will now be seen that one vertical hole in a normal cone, one vertical hole in an adjacent inverted cone, and one slant hole common to both cones constitute a three-hole element of the entire extended array of normal and inverted cones such that the entire extended array can be created by the repetition many times of those three holes in appropriate geometrical relationship, one to another. Similarly the basic procedural steps of the invention can be set forth in terms involving those same three holes, as follows:

drill two vertical boreholes and a slanted borehole into a hydrocarbon-bearing formation such that the slanted hole is close to one vertical hole at one depth and close to the other hole at another depth—one can think of these three holes as forming within the formation the capital letter "N" composed of an inverted "V" joined to an upright "V" with the slant of the "N" being shared by both "V's";

call the space at the narrow end of the inverted "V" the "first portion", the space at the narrow end of the upright "V" the "second portion", the space at the wide portion of the upright "V" the "third portion", and the space at the wide portion of the inverted "V" the "fourth portion", fracture the "first portion" and the "second portion" where distances are small and fracturing is relatively easy, initiate in situ combustion in the fractures of the "first portion" and support this combustion so that it (1) expands throughout the "first portion", (2) produces hydrocarbons into one of the boreholes, and (3) heats the adjacent "third portion" to the point that the "third portion" becomes thermally fractured, initiate in situ combustion in the fractures of the "third portion" and support this combustion so that it (1) expands throughout the "third portion" and the already fractured "second portion", (2) produces hydrocarbons into one of the boreholes, and (3) heats the adjacent "fourth portion" to the point that the "fourth portion" becomes thermally fractured, initiate in situ combustion in the fractures of the "fourth portion" and support this combustion so that it (1) expands throughout the "fourth portion" and (2) produces hydrocarbons into one of the boreholes.

BRIEF DESCRIPTION OF THE DRAWINGS

The foregoing and other objects and benefits of the invention will be more fully set forth below in connection with the best mode contemplated by the inventors of carrying out the invention, and in connection with which there are illustrations provided in the drawings wherein.

DETAILED DESCRIPTION—PART I, LAYOUT

Figure 1:
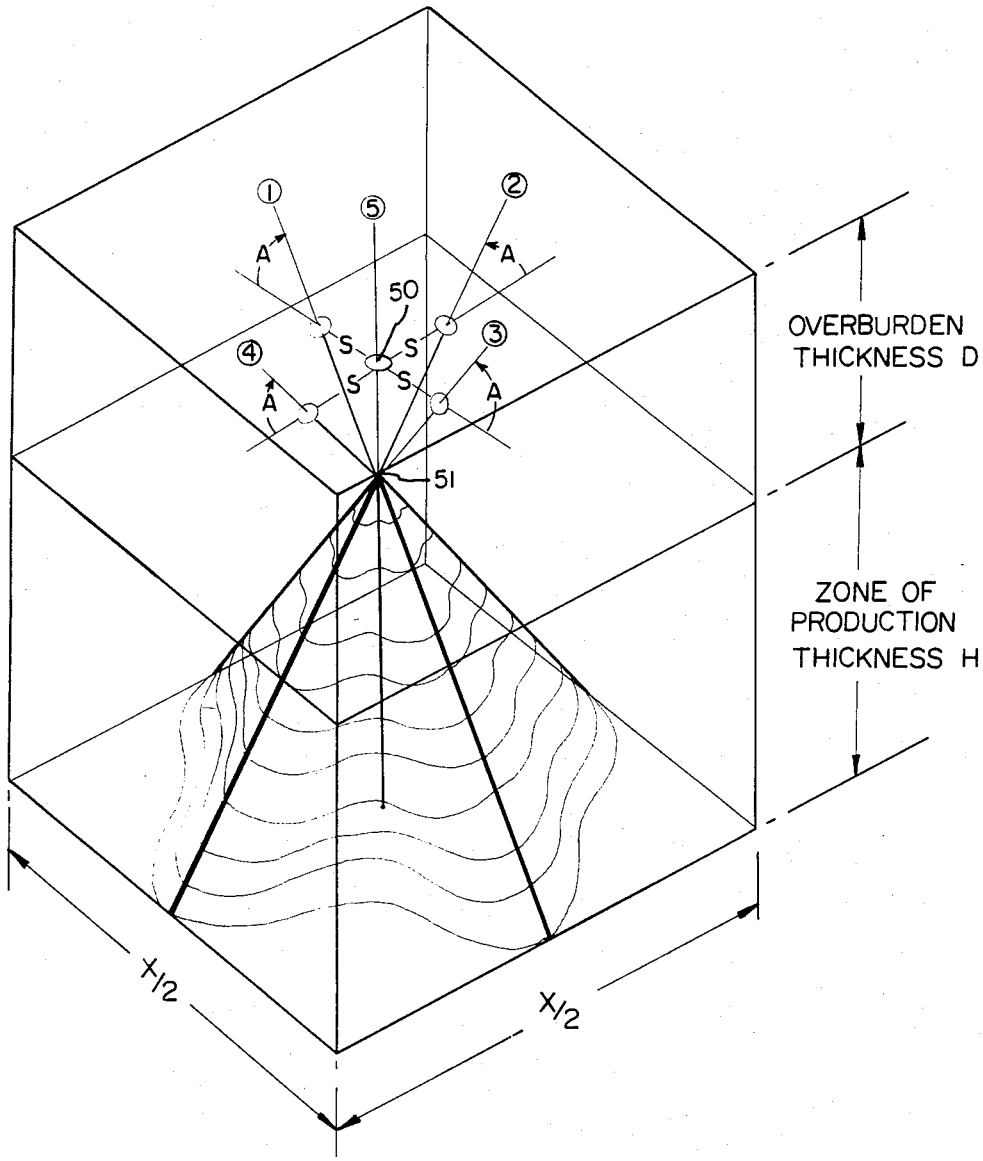
FIG. 1 is a perspective representation of one cone delineated in the zone of production by boreholes drilled in accordance with the invention.

Referring now to FIG. 1, a section of the earth is shown in perspective view in which a shale body or zone of production with a vertical thickness H underlies an overburden having thickness D. As will be set forth more fully below this invention involves the establishment of a plurality of cones delineated by boreholes drilled at angles into the shale body. However in FIG. 1 only one of these cones is illustrated.

At a point 50 on the surface of the earth, i.e. the top of the overburden, a borehole is drilled vertically as indicated by the numeral 5 through the overburden and to the bottom of the zone of production. This hole has a vertical total depth of D+H.

Slant holes, four in number in the present example of FIG. 1, are drilled at an angle A with the horizontal at locations as indicated by numerals 1, 2, 3 and 4, all drilled in such a direction as to intersect at a point 51 at the top of the zone of production. Angle A is chosen such that the cavity left after a cone is produced will have walls which are competent. This choice will depend on a combination of the original state of stress in the production zone, the method of fracture used, the shear failure angle of the rock and the depth of the producing zone. Below point 51 slant holes 1, 2, 3 and 4 diverge as they proceed downwardly through the shale body reaching a total vertical depth of D+H or a total slant depth of (D+H) cosecant A. The locations on the surface of the earth of the starting points of boreholes 1, 2, 3 and 4 are spaced radially from the point 50 by the distance S, where S equals D cot A. Since in this example there are four slant holes, it is preferred to distribute the holes equally around the central borehole at 90° spacings. At the level of total depth, i.e. at the bottom of the zone of production, the slant holes will be separated from each other diametrically by distance (X/2) where X equals 4H cot A.

Figure 2B:
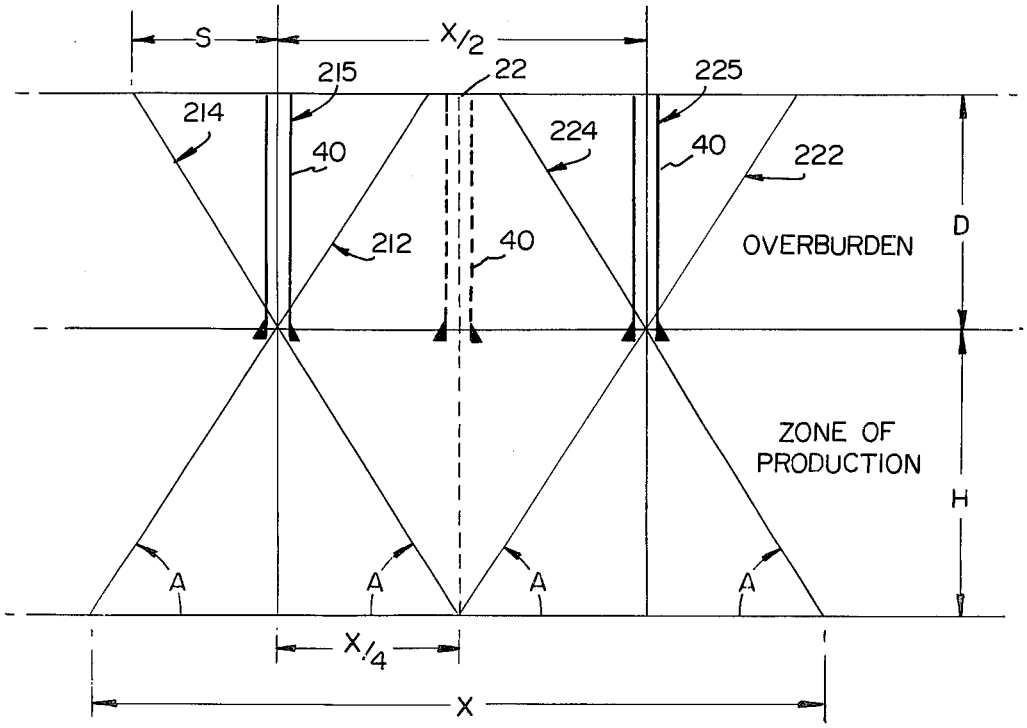
FIG. 2B is an elevation along the line Y—Y of FIG. 2A with the addition that vertical holes are cased to the top of the production zone.
Figure 2A:
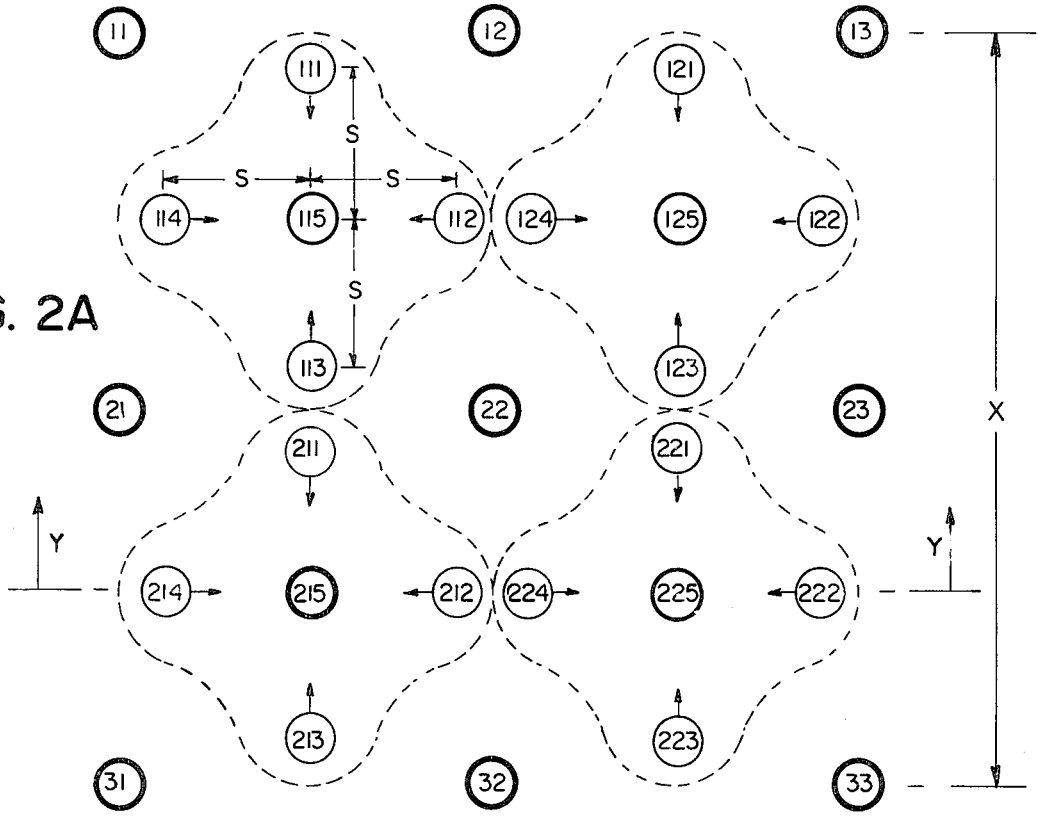
FIG. 2A is a plan view of an array of four cones such as that shown in FIG. 1.

FIG. 2A shows in plan view a square array of four cones such as the one shown singly in FIG. 1. This four cone array constitutes one element, with four sub-elements, which may be repeated side by side as many times as is desired to cover any given area from which production of shale oil from oil shale is to be obtained. In FIG. 2A, vertical holes are indicated by heavy circles, and slant holes by lighter circles. The vertical hole of each individual cone is indicated by a numeral ending in the digit 5, and the slant holes are indicated by 3-digit numerals ending in the digits respectively 1, 2, 3 and 4. It can be seen in FIG. 2A that this group of four normal cones, i.e. with vertices up and bases down, when laid out in plan view as in FIG. 2A leaves an inverted cone, i.e. with base up and vertex down, at the center of the group. The center of this inverted cone is indicated by the heavy circle vertical hole indication 22. Centers of other such inverted cones bordering the four cone group are indicated by the heavy circle vertical hole indications 11, 12, 13, 21, 23, 31, 32, and 33.

The geometrical figure which is the base of each "cone" is a rounded-off polygon and is indicated four times over in FIG. 2A by the dashed lines surrounding each group of four slant holes and one central vertical hole. The nomenclature for the several vertical and slant holes is illustrated by one sub-element of the array taken for example as that to the right of and below the vertical hole indicated by numeral 21. In this sub-element the central vertical hole for the normal cone is indicated by numeral 215. The surrounding four slant holes are indicated by numerals 211, 212, 213 and 214. In every case if these surrounding holes are radially spaced from the central hole a distance S as defined above, and if the slant holes are drilled inwardly towards the central hole at an angle A with the horizontal they will intersect each other at the depth D which is the top of the zone of production. Thereafter they will proceed to the total vertical depth of D+H and be spaced diametrically at that level by the distance (X/2) as defined above.

It is to be understood that this embodiment of the invention described here and illustrated by FIGS. 2A, 2B, and 3A through 3D, while an operative embodiment, is only one element, a square of dimension X on a side, which may be repeated many times contiguously on the surface of the earth. Thus if X is 500 feet, the single element pattern here described and illustrated is a square 500 feet on a side, and the invention may advantageously be performed by operating, for example, 36 such elements in a larger rectangular array, 9 elements by 4 elements, or 4,500 feet by 2,000 feet. In any case, the procedures here described for one element are the same procedures as would be required in each of the other elements.

FIG. 2B is an elevation along the line Y—Y of FIG. 2A in which the vertical holes are shown with casing 40 set to the top of the zone of production. FIG. 2B also shows clearly the geometrical relationships:

$$S = D \cot A$$

$$X = 4H \cot A$$

In the example depicted in these Figures the surface of the earth and also the top and bottom surfaces of the shale body are all assumed to be horizontal. However it is also possible to perform the procedure of this invention in situations where any of these surfaces is oriented other than horizontal by simple geometrical adaptations which will be evident to one skilled in the art.

It will be seen from FIG. 2A that the total number of holes required to be drilled for this four cone pattern is 16 slant holes and 13 vertical holes, for a total of 29 holes. As is well known to those familiar with the art of pattern drilling for production, the ratio is not going to be 13 vertical holes to 16 slant holes in the case of large numbers of cones, but rather drops down to one vertical hole for each two slant holes. The reasons for this change in ratio as the numbers grow large is simply that holes on the perimeter of any given pattern are shared with the adjacent pattern, and the number of boundary holes in a large pattern is a smaller percentage of the total number of holes than in a small array.

A suitable pipe header system is connected to the vertical and slant holes of FIG. 2A, with all the slant holes tied together to a header through which fracturing, fuel, and oxidant fluids are to be pumped for injection into the shale body, and all the vertical holes tied together to a header through which shale oil is to be withdrawn as product.

DETAILED DESCRIPTION—PART II, OPERATIONS

Figure 3A:
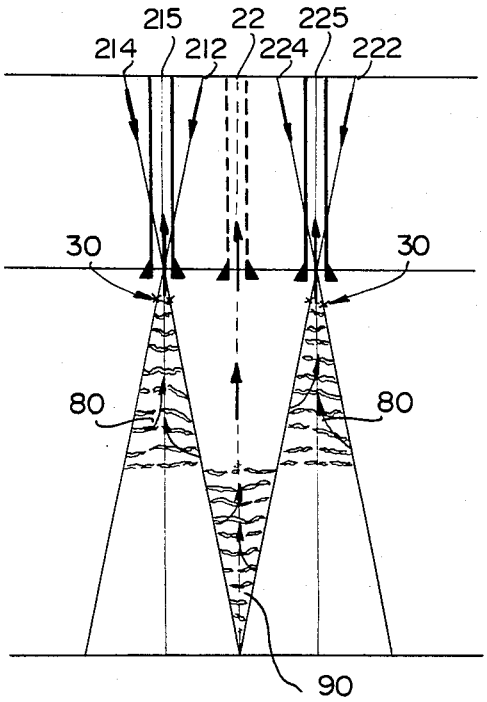
FIG. 3A is an elevation similar to FIG. 2B with the addition that pipe has been set in the slant holes with open hole packers, the slant holes have been pressurized against the packers, and fracturing has been initiated in the vertex regions of both the normal cones and the inverted cone, FIG. 3B, representing the first stage of production, is the same elevation as FIG. 2B after combustion in, and production from, the vertex regions of the normal cones, with resulting thermal fracturing of the base region of the inverted cone, FIG. 3C, representing the second stage of production, is the same elevation as FIG. 2B after combustion in, and production from, the entire inverted cone, FIG. 3D, representing the third stage of production, is the same elevation as FIG. 2B after combustion in, and production from, the base regions of the normal cones.

After the pattern has been laid out and the slant holes and vertical holes drilled and tied into headers as set forth above, the first operational step is to create hydrofractures. Every formation in which the method of the invention is to be practiced is characterized by its own degree of fracturability and has its own characteristic distance over which a fracture can practically be propagated. This distance is herein referred to as the formation's fracture length. FIG. 3A is an elevation similar to that of FIG. 2B. Open hole packers 30 are set in all the slant holes near the vertices of the normal cones. Pipe is also set in these slant holes down to the open hole packers to enable the application of hydrofracturing pressure to the formations. The slant holes are then pressurized against the open hole packers by the introduction of hydrofracturing fluids through the pipe header system. When communication is established in the upper or vertex portions of the normal cones by fracturing these portions valves are closed on center wells 215 and 225 in the illustration of FIG. 3A. This forces the fracturing fluid to then break through at the lower portions (i.e. vertex portions) of the inverted cones. Fractures are developed between the slant holes and vertical borehole 22. As the fractures are initiated pressure is maintained in the slant holes by a high volume flow rate. FIG. 3A shows the fracture regions 80 in the vertex portions of the normal cones and 90 in the vertex portions of the inverted cones with arrows indicating direction of fluid flow which brought about these fractures, i.e. down the slant holes and up the vertical holes.

It is to be understood in connection with this description of the procedure of this invention and with FIGS. 3A through 3D that steps which are here described as taking place in slant holes 214, 212, 224, and 222 would actually take place in all the slant holes of the FIG. 2A pattern, i.e. 111, −2, −3, −4, 121, −2, −3, −4, 211, −2, −3, −4, and 221, −2, −3, −4. Steps here described as taking place in vertical holes 215 and 225 would actually take place in all the normal cone vertical holes of the FIG. 2A pattern, i.e. 115, 125, 215, and 225. Steps here described as taking place in vertical hole 22 would actually take place in all the inverted cone vertical holes of the FIG. 2A pattern, i.e. 11, 12, 13, 21, 22, 23, 31, 32, and 33.

Preparations are then made to remove residual water by air injection and to perform permeability determinations by water flow and air flow from the vertical cased production wells. Air is injected into the slant wells, and the water used in the fracture process is forced out through the vertical wells. Flow rates of water and of air are then measured to obtain the desired permeability estimates for both water and air.

Figure 3B:
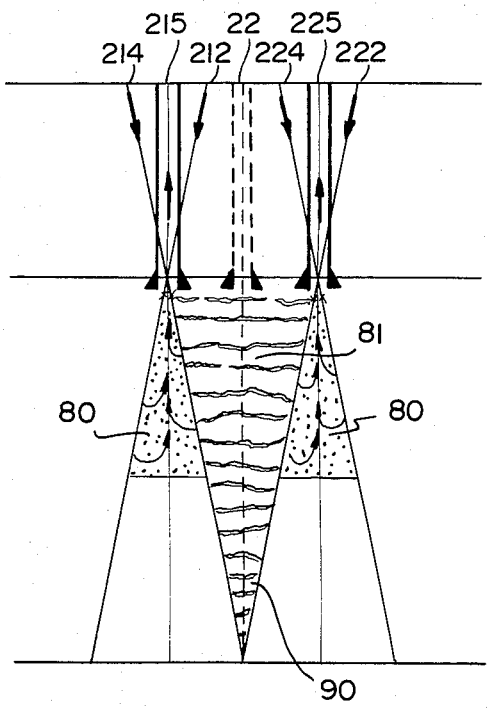

The first stage of production, in which the vertex portions of the normal cones are produced, is now begun and is illustrated in FIG. 3B. A mixture of a fuel, for example propane, and an oxidant, for example air, is injected through the pipe header system into the slant holes as indicated by downward arrows in boreholes 214, 212, 224 and 222 of FIG. 3B, with the valves open on vertical holes 215 and 225 and the valve closed on vertical hole 22. The fuel is then ignited by well known procedures for initiating in situ combustion, and a combustion process is thereby introduced into the fractured regions 80 in the vertex portions of the normal cones. The combustion process sweeps through the regions 80 with resultant production of shale oil from the oil shale therein as indicated by the cross hatching of fractured regions 80. Arrows in slant holes in FIG. 3B show the direction of flow of the fuel and oxidant gases, while arrows up the vertical holes indicate the flow of production. Curved arrows within the cross hatched region in FIG. 3B show the direction of movement of the combustion front as it advances from the slant holes to the vertical hole. The combustion process which has been initiated in the vertex portions of the normal cones proceeds not only laterally but also downward through those vertex portions. In addition, the heat generated by the combustion process in the vertex portions of the normal cones causes thermal fracturing of the adjacent base portion of the inverted cone by stress cracking of the shale body on its horizontal bedding planes. The inverted cone thus now contains in addition to the fractured region 90 in its vertex portion the newly fractured region 81 in its base portion.

Figure 3C:
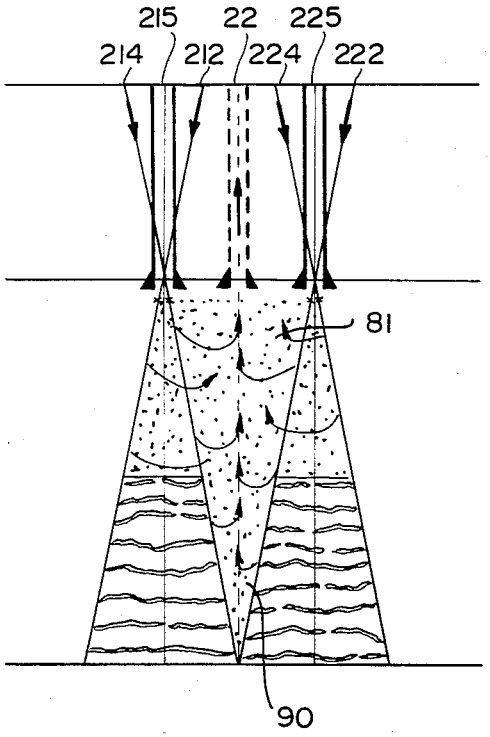

The second stage of production, in which the entire inverted cone is produced, is then begun and is illustrated in FIG. 3C. Valves are closed on the well heads of holes 215 and 225 and opened on the well head of hole 22. Mixed fuel and oxidant gases are injected into and ignited within the slant holes as indicated by downward arrows in holes 214, 212, 224 and 222. These gases are preheated as they pass through the vertex portions of the burned out normal cones, thus reducing the amount of propane required from that required previously. The combustion process now takes place starting laterally in the base portion 81, then burning down into the vertex portion 90 of the inverted cone. The result of this new combustion step in the inverted cone is that production flows up the center of the inverted cone as indicated by the upward arrow and that thermal fracture now takes place in the base portions of the normal cones due to the heat generated in the adjacent vertex portion of the inverted cone.

Figure 3D:
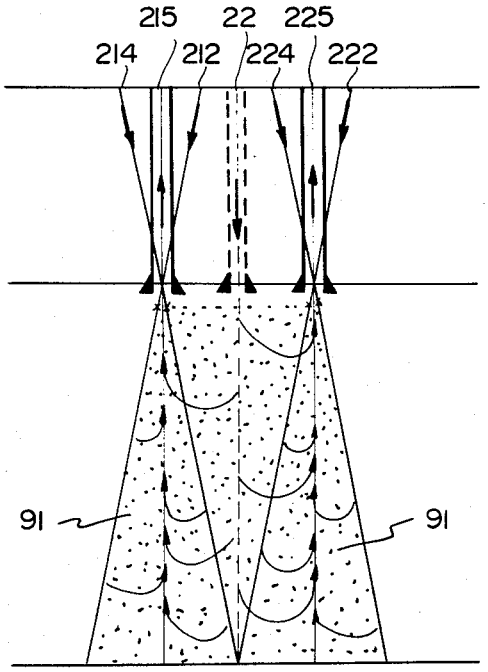

The third stage of production, in which the base portions of the normal cones are produced, is then begun and is illustrated in FIG. 3D. Fuel and oxidant gases are now injected into and ignited within the slant holes as indicated by downward arrows, with the valves open on the well heads of the central boreholes 215 and 225 in the normal cones. In addition the fuel and oxidant gases are injected into the vertical hole 22 in the center of the inverted cone. The combustion and production process then proceeds laterally and upwardly through the base portions 91 of the normal cones. In this step it will be seen that all of the fuel and oxidant gas mixture is preheated by passage through the upper portion of the production zone. Production is forced out of the central wells in the normal cones as indicated by the upward arrows.

The basic geometrical relationships between all the vertical and slant holes of this invention can best be seen by starting with one vertical hole such as hole 22, one vertical hole such as hole 215, and one slant hole such as hole 214 of FIGS. 2A and 2B. It will be seen that the entire pattern of FIGS. 2A and 2B can be built up by repetition of such holes and their relationships. Three holes which stand in the same relationship with each other as holes 22, 215, and 214 respectively are vertical first hole 101, vertical second hole 102, and slanted third hole 103—see FIG. 4, which is a plan view. Slant hole 103 reaches total depth D+H at a point which is projected on the plan view of FIG. 4 as 103'. The distance from 102 to 103 is S, just as in FIGS. 2A and 2B. The distance from 102 to 103' is X/4, just as in FIGS. 2A and 2B. The distances from 101 to 103, 102, and 103' respectively are designated L, F, and R in FIG. 4, and the angle between the direction from 101 to 102 and the direction from 102 to 103 is designated W in FIG. 4. The following geometrical relationships involving S, X, L, F, R, and W are true for any array, including but not limited to the illustrated square array of FIGS. 2A and 2B.

$$L^2=F^2+S^2+2FS\cos W$$

$$R^2=F^2+(X/4)^2-(2FX/4)\cos W$$

It will also be remembered that $$S=D\cot A$$

and $$X=4H\cot A.$$

Figure 4:
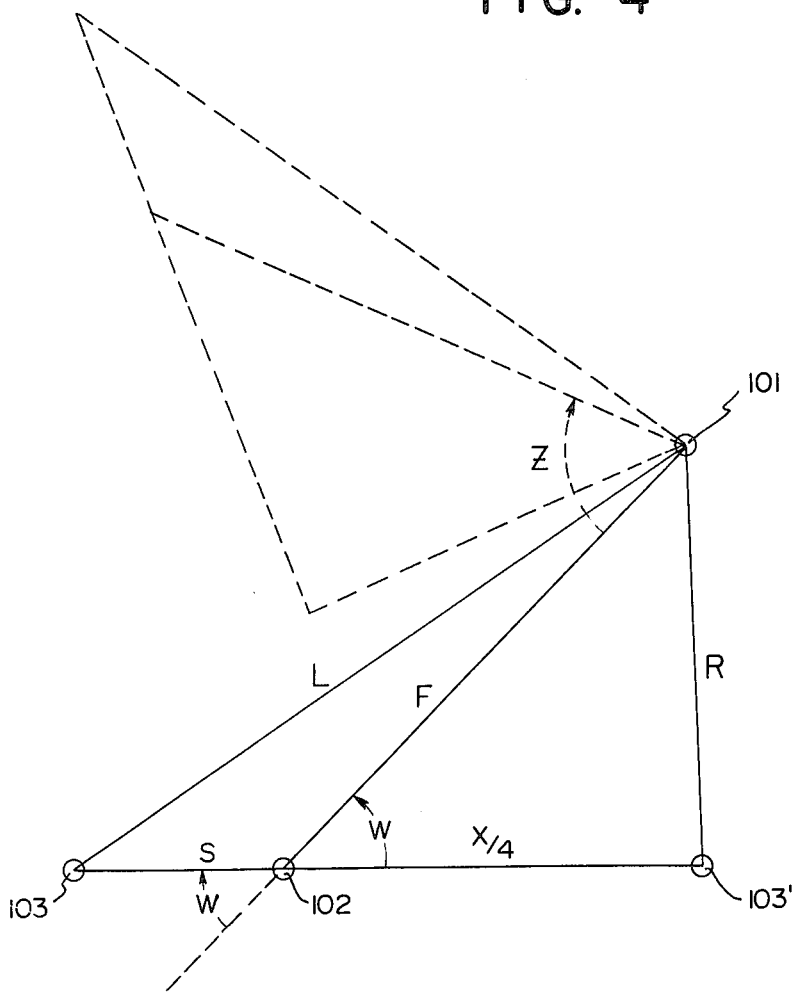
FIG. 4 is a plan view showing certain geometrical relationships that are involved in the method of the invention, which relationships are true in general and not for the illustrated square array only.

FIG. 4 also shows by broken lines the distance and angle parameters for the next adjacent sub-element to that shown by the solid lines. It can be shown that in order to have the circular bases of adjacent sub-element cones contact each other but not overlap, the angular displacement between two adjacent sub-elements must be $$Z=arc\cos[1-(2H^2\cot^2 A)/F^2]$$

It can also be shown that when adjacent sub-elements are angularly displaced from each other by angle Z, it will be possible to have one slant hole from each of two adjacent sub-elements arrive at the point of contact of the bases at depth D+H if the number of slant holes in each sub-element is the number 360°/Z, and if the slant holes in each sub-element are displaced from each other within the sub-element by the angle Z. Examples: for X=141.4 feet and F=50 feet, Z would be 90° and the number of slant holes per sub-element would be 4; for X=100 feet and F=50 feet, Z would be 60° and the number of slant holes per sub-element would be 6.

In laying out a pattern for this invention one chooses F to be not larger than the fracture length of the formation. Also R should be not larger than F. To assure that R is equal to or less than F, the angle W must be equal to or less than arc cos [(H cot A)/2F]

Although only one embodiment of the invention has been described above, modifications can be made without departing from the spirit and scope of the invention. All such modifications are intended to be included within the scope of the invention, which is to be limited only by the following claims.

We claim:

1. The method of producing hydrocarbons from a subterranean fracturable hydrocarbon-bearing formation characterized by a fracture length comprising the steps of drilling a first borehole into said formation from a first location on the surface of the earth, drilling second and third boreholes into said formation from second and third locations on the surface of the earth spaced from each other and from said first location, said second and third boreholes being drilled in such directions that they converge and are disposed in close proximity with one another at a predetermined depth in said formation and said third borehole is spaced from said first borehole at said predetermined depth a distance not greater than said fracture length, fracturing at said predetermined depth a first portion of said formation included between said second and third boreholes to create a fractured communication path therebetween, initiating in said third borehole at said fractured communication path a combustion process having a combustion front, maintaining said combustion front by injection of a combustion-supporting gas into said third borehole so that said front proceeds through said formation first portion and produces hydrocarbons into said second borehole, said combustion process heating a second portion of said formation adjacent to said formation first portion included between said third and first boreholes to a temperature at which thermal fracturing occurs in said formation to create a thermofractured communication path within said formation second portion between said third and first boreholes, initiating in said third borehole at said thermofractured communication path a process having a second combustion front, maintaining said second combustion front by injection of a combustion-supporting gas into said third borehole so that said front proceeds through said formation second portion and produces hydrocarbons into said first borehole, and producing hydrocarbons from said first and second boreholes.

2. The method of claim 1 wherein said formation is an oil shale formation.

3. The method of claim 1 wherein said first and second boreholes are vertical.

4. The method of claim 1 wherein said boreholes are drilled with a rotary percussion air operated drill with tungsten carbide bits and all fracturing steps are followed by introduction of propping agents.

5. The method of producing hydrocarbons from a subterranean hydrocarbon-bearing formation comprising the steps of drilling from spaced first, second and third locations on the surface of the earth downwardly into said formation respectively a vertical first borehole a vertical second borehole and a third borehole slanted in such direction that said second and third boreholes converge and are disposed in close proximity with one another at a first predetermined depth in said formation and said first and third boreholes converge and are disposed in close proximity with one another at a second predetermined depth in said formation, fracturing at said first predetermined depth a first portion of said formation included between said second and third boreholes to create a first fractured communication path therebetween, fracturing at said second predetermined depth a second portion of said formation included between said first and third boreholes to create a second fractured communication path therebetween, initiating in said third borehole at said first fractured commmunication path a combustion process having a first combustion front, maintaining said first combustion front by injection of a combustion-supporting gas into said third borehole so that said front proceeds laterally through said formation first portion and spreads vertically into formation portions adjacent thereto to produce hydrocarbons into said second borehole, said combustion process heating a third portion of said formation adjacent to said formation first portion included between said third and first boreholes to a temperature at which thermal fracturing occurs in said formation to create a first thermofractured communication path within said formation third portion, initiating in said third borehole at said first thermofractured communication path a process having a second combustion front, maintaining said second combustion front by injection of a combustion-supporting gas into said third borehole so that said front proceeds laterally through said formation third portion and spreads vertically into and through said fractured second portion to produce hydrocarbons into said first borehole, said combustion process heating a fourth portion of said formation adjacent to said formation second portion included between said second and third boreholes to a temperature at which thermal fracturing occurs in said formation to create a second thermofractured communication path within said formation fourth portion, initiating in said third borehole at said second thermofractured communication path a process having a third combustion front, maintaining said third combustion front by injection of a combustion-supporting gas into said third borehole so that said front proceeds laterally through said formation fourth portion and spreads vertically into formation portions adjacent thereto to produce hydrocarbons into said second borehole, and producing hydrocarbons from said first and second boreholes.

6. The method of claim 5 wherein said formation is an oil shale formation.

7. The method of claim 5 wherein said boreholes are drilled with a rotary percussion air operated drill with tungsten carbide bits and all fracturing steps are followed by introduction of propping agents.

8. The method of producing hydrocarbons from a subterranean fracturable hydrocarbon-bearing formation having a characteristic fracture length comprising the steps of drilling from spaced first, second and third locations on the surface of the earth downwardly into said formation respectively a vertical first borehole a vertical second borehole and a third borehole slanted in such direction that said second and third boreholes converge and are disposed in close proximity with one another at a first predetermined depth in said formation, said third borehole is within said fracture length of said first borehole at said first predetermined depth, and said first and third boreholes converge and are disposed at a distance not greater than said fracture length from one another at a second predetermined depth in said formation, fracturing at said first predetermined depth a first portion of said formation included between said second and third boreholes to create a first fractured communication path therebetween, fracturing at said second predetermined depth a second portion of said formation included between said first and third boreholes to create a second fractured communication path therebetween, initiating in said third borehole at said first fractured communication path a combustion process having a first combustion front, maintaining said first combustion front by injection of a combustion-supporting gas into said third borehole so that said front proceeds laterally through said formation first portion and spreads vertically into formation portions adjacent thereto to produce hydrocarbons into said second borehole, said combustion process heating a third portion of said formation adjacent to said formation first portion included between said third and first boreholes to a temperature at which thermal fracturing occurs in said formation to create a first thermofractured communication path within said formation third portion, initiating in said third borehole at said first thermofractured communication path a process having a second combustion front, maintaining said second combustion front by injection of a combustion-supporting gas into said third borehole so that said front proceeds laterally through said formation third portion and spreads vertically into and through said formation second portion to produce hydrocarbons into said first borehole, said combustion process heating a fourth portion of said formation adjacent to said formation second portion included between said second and third boreholes to a temperature at which thermal fracturing occurs in said formation to create a second thermofractured communication path within said formation fourth portion, initiating in said third borehole at said second thermofractured communication path a process having a third combustion front, maintaining said third combustion front by injection of a combustion-supporting gas into said third borehole so that said front proceeds laterally through said formation fourth portion and spreads vertically into formation portions adjacent thereto to produce hydrocarbons into said second borehole, and producing hydrocarbons from said first and second boreholes.

9. The method of claim 8 wherein said formation is an oil shale formation.

10. The method of claim 8 wherein said boreholes are drilled with a rotary percussion air operated drill with tungsten carbide bits and all fracturing steps are followed by introduction of propping agents.

11. The method of producing hydrocarbons from a fracturable hydrocarbon-bearing formation of thickness H underlying an overburden of thickness D said formation characterized by fracture length $L_F$ and by structural competence to maintain a normal cone-shaped cavity therein having sides at an angle A with the horizontal comprising the steps of drilling vertically to depth D+H a first borehole from a first surface location and a second borehole from a second surface location spaced a distance F not greater than $L_F$ from said first surface location and drilling a third borehole slanted at angle A with the horizontal in the direction of said second borehole from a third surface location spaced a distance S from said second surface location in a direction at an angle W with the direction from said first to said second surface locations so that said second and third boreholes converge and are disposed in close proximity with one another at depth D and said first and third boreholes converge and are disposed at a distance not more than F from one another at depth D+H, where $$S = D \cot A$$

and $$W = \arccos [(H \cot A)/(2F)],$$

fracturing at depth D a first portion of said formation included between said second and third boreholes to create a first fractured communication path therebetween, fracturing at depth D+H a second portion of said formation included between said first and third boreholes to create a second fractured communication path therebetween, initiating in said third borehole at said first fractured communication path a combustion process having a first combustion front, maintaining said first combustion front by injection of a combustion-supporting gas into said third borehole so that said front proceeds laterally through said formation first portion and spreads vertically into formation portions adjacent thereto to produce hydrocarbons into said second borehole, said combustion process heating a third portion of said formation adjacent to said formation first portion included between said third and first boreholes to a temperature at which thermal fracturing occurs in said formation to create a first thermofractured communication path within said formation third portion, initiating in said third borehole at said first thermofractured communication path a process having a second combustion front, maintaining said second combustion front by injection of a combustion-supporting gas into said third borehole so that said front proceeds laterally through said formation third portion and spreads vertically into and through said formation second portion to produce hydrocarbons into said first borehole, said combustion process heating a fourth portion of said formation adjacent to said formation second portion included between said second and third boreholes to a temperature at which thermal fracturing occurs in said formation to create a second thermofractured communication path within said formation fourth portion, initiating in said third borehole at said second thermofractured communication path a process having a third combustion front, maintaining said third combustion front by injection of a combustion-supporting gas into said third borehole so that said front proceeds laterally through said formation fourth portion and spreads vertically into formation portions adjacent thereto to produce hydrocarbons into said second borehole, and producing hydrocarbons from said first and second boreholes.

12. The method of claim 11 wherein said formation is an oil shale formation.

13. The method of claim 11 wherein said boreholes are drilled with a rotary percussion air operated drill with tungsten carbide bits and all fracturing steps are followed by introduction of propping agents.

14. The method of claim 11 wherein upon completion of the steps therein the entire procedure is repeated using the same first borehole, a new second borehole spaced as in claim 11 but in a direction angularly spaced from the line connecting said first and second boreholes by the angle whose cosine is $$[1-(2H^2 \cot^2 A)/F^2]$$

and other spacings and angles the same as provided in claim 11.

15. The method of producing hydrocarbons from a subterranean hydrocarbon-bearing formation comprising the steps of drilling a vertical first borehole and a vertical second borehole spaced therefrom into said formation, drilling a slanted third borehole such that it passes in close proximity to said second borehole at a first depth and in close proximity to said first borehole at a second depth thereby defining portions of said formation including a first portion lying between said second and third boreholes in the vicinity of said first depth, a second portion lying between said first and third boreholes in the vicinity of said second depth, a third portion lying between said first and third boreholes in the vicinity of said first depth, and a fourth portion lying between said second and third boreholes in the vicinity of said second depth, fracturing the formation in said first and second portions to create respectively first and second fractured communication paths therein, initiating a combustion process in said first fractured communication path, supporting in said first fractured communication path said combustion process so that it (1) expands through said fractured first portion, (2) produces hydrocarbons into one of said boreholes, and (3) thermally fractures said formation in said third portion to create a first thermofractured communication path therein, initiating a combustion process in said first thermofractured communication path, supporting in said first thermofractured communication path said combustion process so that it (1) expands through said thermofractured third portion and said fractured second portion, (2) produces hydrocarbons into one of said boreholes, and (3) thermally fractures said formation in said fourth portion to create a second thermofractured communication path therein, initiating a combustion process in said second thermofractured communication path, supporting said combustion process in said second thermofractured communication path so that it (1) expands through said thermofractured fourth portion and (2) produces hydrocarbons into one of said boreholes, and producing hydrocarbons from said boreholes into which hydrocarbons are produced.

* * * * *